US008202371B2

(12) United States Patent
Marettek et al.

(10) Patent No.: US 8,202,371 B2
(45) Date of Patent: Jun. 19, 2012

(54) METHOD FOR SHORTENED CLEAR RINSE IN A DISHWASHER AND DISHWASHER ADAPTED TO CARRY OUT SUCH METHOD

(75) Inventors: Andreas Marettek, Sulzbach (DE); Anja M. Bies, Dillingen (DE)

(73) Assignee: Whirlpool Corporation, Benton Harbor, MI (US)

( * ) Notice: Subject to any disclaimer, the term of this patent is extended or adjusted under 35 U.S.C. 154(b) by 362 days.

(21) Appl. No.: 12/481,624

(22) Filed: Jun. 10, 2009

(65) Prior Publication Data

US 2009/0301526 A1 Dec. 10, 2009

(30) Foreign Application Priority Data

Jun. 10, 2008 (EP) ..... 08157923

(51) Int. Cl.

| | |
|---|---|
| ***B08B 9/20*** | (2006.01) |
| ***B08B 7/04*** | (2006.01) |
| ***B08B 7/00*** | (2006.01) |
| ***B08B 1/02*** | (2006.01) |
| ***B08B 9/093*** | (2006.01) |
| ***B08B 9/04*** | (2006.01) |
| ***B08B 3/00*** | (2006.01) |

(52) U.S. Cl. ..... 134/25.2; 134/18; 134/19; 134/32; 134/22.18; 134/24; 134/56 D

(58) Field of Classification Search ..... 134/25.2, 134/42, 18, 22.12, 24, 56 D
See application file for complete search history.

(56) References Cited

U.S. PATENT DOCUMENTS 5,264,043 A * 11/1993 Milocco ..... 134/25.2

FOREIGN PATENT DOCUMENTS

EP 1723895 * 11/2006

OTHER PUBLICATIONS

English Translation EP1723895.*

* cited by examiner

*Primary Examiner* — Michael Kornakov
*Assistant Examiner* — Arlyn I Rivera-Cordero
(74) *Attorney, Agent, or Firm* — Robert A. Bacon; Diederiks & Whitelaw PLC

(57) ABSTRACT

A method for rinsing crockery in a dishwashing machine is disclosed. The dishwashing machine includes a circulation pump, a water heater, an upper spray arm and a lower spray arm both alternatively fed by the circulation pump. The method includes the step of heating of the rinsing circulated water up to a maximum predetermined value. The method further includes the step of interrupting the feeding of the lower spray arm when a threshold water temperature is reached so that only the upper spray arm is fed by the circulated water.

11 Claims, 1 Drawing Sheet

METHOD FOR SHORTENED CLEAR RINSE IN A DISHWASHER AND DISHWASHER ADAPTED TO CARRY OUT SUCH METHOD

BACKGROUND OF THE DISCLOSURE

1. Field of the Invention

The present disclosure relates to a method for rinsing crockery in a dishwashing machine. This disclosure particularly relates to a rinsing method for a dishwasher having a circulation pump, a water heater, an upper spray arm and a lower spray arm both alternatively fed by the circulation pump, such method comprising the continuous heating of the rinsing circulated water up to a maximum predetermined value.

With the term "crockery" we mean every kind of vessels, plates, dishes, pans, pots, glasses, cutlery etc. that are usually loaded into a dishwasher.

2. Description of the Related Art

A regular cycle of a dishwasher uses the above known final rinse method in which, after having reached a predetermined temperature of the rinsing water, a follow-up phase is used in which the water is continuously circulated through the spray arms without a further heating of water. The usual duration of this follow-up phase is about 10 min after reaching the maximum temperature.

In such known method, after the follow-up phase, the water temperature is about 5° C. lower than the maximum temperature due to heat losses, depending on the rinse time. The cleaning performance is strongly affected by the rinse total time of the upper spray arm (the sum of time periods during which the upper spray arm is working), since also during finale rinse stage a soil removal is needed (for instance burnt-on soil in crockery placed on the upper rack). According to the known rinsing method, the upper spray arm is fed in an alternating way with the lower spray arm for the entire rinsing phase. Moreover, a specific minimum temperature after clear rinse is requested to maintain the drying performance, such temperature being of the order of 59° C.

In the last years the appliance producers have focused their attention to energy saving, for instance by new cycle designs or by adopting more energy efficient components.

SUMMARY OF THE DISCLOSURE

An aspect of the present disclosure is to provide a rinsing method which could contribute significantly in an energy saving of the dishwasher during its washing cycle.

The solution of a new optimized clear rinse according to the present disclosure allows the same total rinse time of the upper spray arm as in the current alternate wash mode while maintaining a good washing performance, but with strongly reduced or cancelled follow-up time in order to reduce heating losses before the last drying phase.

With a reduced follow-up time it is possible to reduce the maximum heat-up temperature while maintaining drying start temperature (option of energy saving) or to maintain a higher rinse temperature and to increase the starting temperature for a faster drying (option of cycle time reduction).

The basic idea underlying the present disclosure is to reduce the overall spray time in order to reduce heat transfer losses, while keeping a rinse time sufficient for the crockery (for instance glasses) in the upper rack. The applicant has discovered that dishes in the lower rack are already clean during final rinse, and therefore they do not need further direct rinsing (i.e. it is possible to use the upper spray arm for the most part of the rinsing phase).

According to a feature of a method according to the present disclosure, after reaching a threshold temperature comprised between 35° and 55° C., more preferably between 40° and 50° C., more preferably around 45° C., the alternating mode of the two spray arms is stopped while the upper spray arm only proceeds to spray rinsing water until the maximum water temperature is reached. A short follow-up time of about 2 min completes the wash cycle, depending on the requested washing performance class. The follow-up time can be completely omitted.

BRIEF DESCRIPTION OF THE DRAWINGS

Further advantages and features according to the present disclosure will be clear from the detailed following description, with reference to the attached drawings in which.

DETAILED DESCRIPTION

Figure 1:
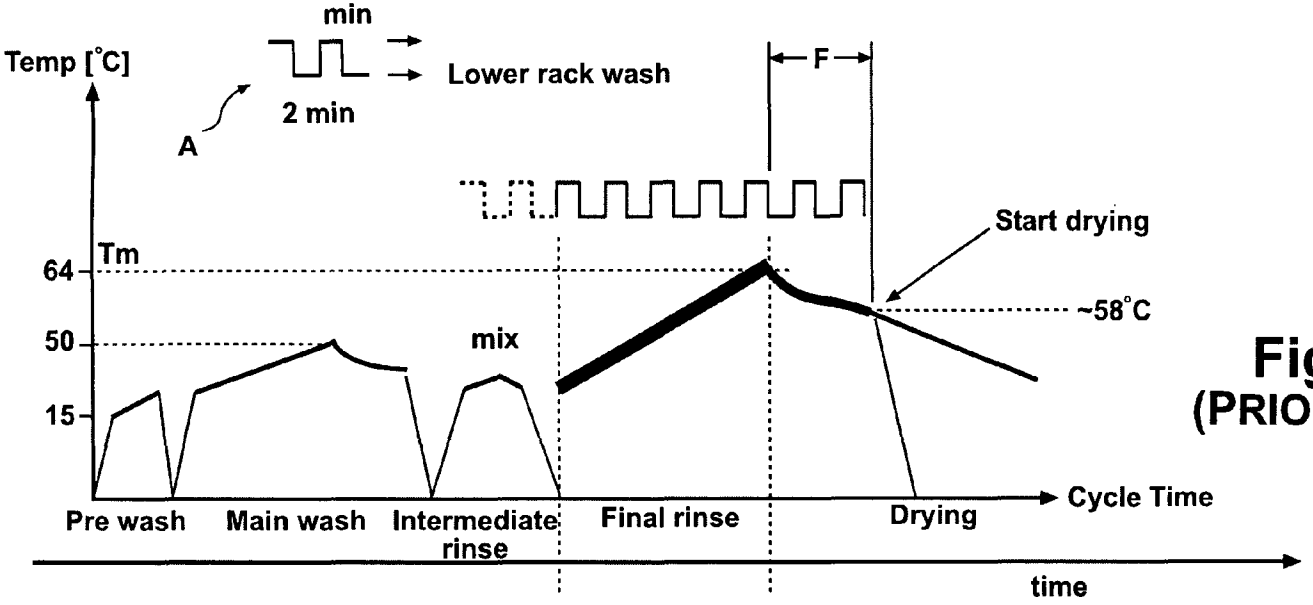
Fig. 1 (PRIOR ART)
FIG. 1 is a diagram showing a washing cycle according to a known dishwasher.

With reference to FIG. 1, a known wash cycle of a traditional dishwasher comprise a pre-wash phase followed by a main wash phase where the circulated water, heated by a heat exchanger, can reach a typical temperature around 50° C. After the main wash phase an intermediate rinse is carried out. During all the above three phases the lower spray arm and the upper spray arm are alternatively fed by the circulation pump according to the pattern shown in detail A of FIG. 1 (i.e. the lower spray arm is fed for a time period of about 2 minutes, and then the upper spray arm is fed for the same period while the lower spray arm is idle). It is well known in the art that the alternating way of feeding the spray arms have big advantages in energy saving and in washing efficiency, since the water jets can impinge the crockery with higher force.

In the final rinse according to the known washing cycle shown in FIG. 1, clear water is circulated by the pump while its temperature is increased up to a maximum predetermined value Tm around 64° C. When this temperature is reached, the water heater is switched off while the water is circulated with the same alternating pattern as in the heating phase. During this period, called "follow-up time" (indicated with reference F in FIG. 1), which takes about 10 minutes, the temperature of the circulating water decreases due to heat transmission outside the machine, down to a temperature around 58° C. At this point the water is drained out and a drying stage is started (which is the final stage of the whole washing cycle).

Figure 2:
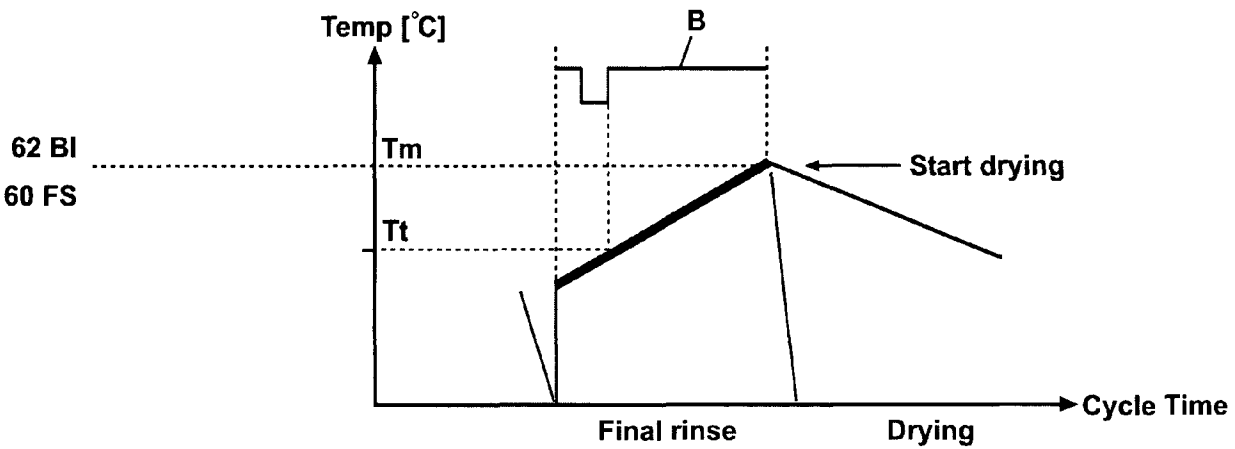
FIG. 2 is a diagram similar to FIG. 1 in which the final rinse is carried out according to the present disclosure.

With reference to FIG. 2, the phases of pre wash, main wash and intermediate rinse of a dishwashing machine according to this disclosure are not different from the phases of the known machines. According to the disclosure, a change of the final rinse only allows a surprising result in terms of energy saving. In the final rinse phase according to the disclosure when the temperature of the continuously heated circulated water reaches a predetermined threshold value Tt around 45° C. the alternating wash (carried out by means of a diverter valve) is switched off and only the upper spray arm is fed by the circulating pump (as it is indicated in portion B of FIG. 2). When the temperature of water reaches a predetermined maximum value Tm (which according to the disclosure can be lower than in the prior art, i.e. comprised between 58° and 64° C., more preferably between 59° and 63° C. and more preferably around 60° C. for free-standing dishwasher and around 62° C. for built-in dishwasher), then the circulation pump is switched off and the drying phase can be started with a crockery at an initial temperature higher than in known machines, allowing better drying performances.

The overall energy saving of a dishwashing machine according to the present disclosure is about 80 Wh compared to the present models, while maintaining or improving the result in terms of washing and drying performances. About 40 Wh of energy saving derives from the lower temperature reached in the final rinse, while the remaining 40 Wh derives form the reduction or elimination of the follow-up time.

Tests carried out have shown that the temperature reduction in the final rinse step, which could reduce the washing performances, is compensated by running the upper spray arm only for most of the final rinse phase, so that residues as burned-on milk on glasses are effectively removed. By reducing or eliminating the 10 minutes follow-up period after the heating period leads to betters drying performances due to a higher start temperature, leaving aside the advantage of reducing the overall washing cycle time.

It should be understood that a dishwashing machine utilized to perform the present invention generally comprises: a circulation pump, a water heater, an upper spray arm, a lower spray arm, and a control process unit. In accordance with the invention, the control process unit is adapted to drive the dishwashing machine in a final rinsing phase in which the recirculated rinsing water is heated up to maximum predetermined value and in which both the upper and lower spray arms are fed alternatively by the circulation pump. The control process unit drives the feeding of the upper spray arm only after the water has reached a threshold temperature. Further, the control process unit is adapted to interrupt the circulation of rinsing water upon reaching the maximum temperature value as described above.

The invention claimed is:

1. A method for rinsing crockery in a dishwashing machine having a circulation pump, a water heater, an upper spray arm and a lower spray arm both alternatively fed by the circulation pump, the method comprising:

initiating a rinse phase alternating a feeding of rinsing fluid between the upper spray arm and the lower spray arm while heating the rinsing fluid; and interrupting the feeding of the rinsing fluid to the lower spray arm such that the rinsing fluid is only fed to the upper spray arm when a threshold water temperature of the rinsing fluid is reached.

2. The method according to claim 1, further comprising:

heating the rinsing fluid to a maximum predetermined temperature value; and interrupting the feeding of rinse fluid to the upper spray arm when the maximum predetermined temperature value is reached.

3. The method according to claim 2, wherein:

the maximum predetermined temperature value is between 58° and 64° C.

4. The method according to claim 3, wherein:

the maximum predetermined temperature value is about 60° C. when the dishwashing machine is a free-standing dishwasher and about 62° C. when the dishwashing machine is a built-in dishwasher.

5. The method according to claim 3, wherein:

the maximum predetermined temperature value is between 59° and 63° C.

6. The method according to claim 2, wherein:

a drying phase is started immediately after the rinsing fluid has reached the maximum predetermined temperature value.

7. The method according to claim 1, wherein:

the threshold water temperature is between 35° and 55° C.

8. The method according to claim 7, wherein:

the threshold water temperature is between 40° and 50° C.

9. The method according to claim 7, wherein:

the threshold water temperature is about 45° C.

10. A dishwashing machine, comprising:

a circulation pump;

a water heater;

an upper spray arm;

a lower spray arm; and a control process unit configured to:

a) initiate a rinse phase during which rinsing fluid is alternately fed between the upper spray arm and the lower spray arm while being heated; and b) interrupt the feeding of the rinsing fluid to the lower spray arm such that the rinsing fluid is only fed to the upper spray arm when a threshold water temperature of the rinsing fluid is reached.

11. The dishwashing machine according to claim 10, wherein:

the control process unit is adapted to interrupt the circulation of the rinsing fluid to the upper spray arm upon the rinsing fluid reaching a maximum temperature value.

* * * * *